US007040050B2

(12) United States Patent
Skinner

(10) Patent No.: US 7,040,050 B2
(45) Date of Patent: May 9, 2006

(54) WINDOW-LIKE DISPLAY WITH SNOW EFFECT

(76) Inventor: Greg T. Skinner, 119 Melody La., Largo, FL (US) 33771

( * ) Notice: Subject to any disclaimer, the term of this patent is extended or adjusted under 35 U.S.C. 154(b) by 18 days.

(21) Appl. No.: 10/725,547

(22) Filed: Dec. 3, 2003

(65) Prior Publication Data

US 2005/0120602 A1 Jun. 9, 2005

(51) Int. Cl.
*G09F 19/00* (2006.01)

(52) U.S. Cl. ..... 40/410; 40/439

(58) Field of Classification Search ..... 40/410, 40/409, 406, 407, 439; 239/211, 14.2
See application file for complete search history.

(56) References Cited

U.S. PATENT DOCUMENTS 2,543,606 A * 2/1951 Randolph et al. ..... 40/410
5,979,091 A * 11/1999 TenBrink ..... 40/410
6,550,169 B1 * 4/2003 Sena et al. ..... 40/410
2003/0177677 A1 * 9/2003 Acosta, Sr. ..... 40/410

* cited by examiner

*Primary Examiner*—Gary C. Hoge

(57) ABSTRACT

An amusement device for simulating the appearance of snow including a window-like structure having a space between 2 front panes and a rear pane, where at least one of the panes is a transparent pane, and the panes are mounted in a frame support. There is a recycling system for circulating artificial snow, which falls down, from the top of the window-like structure and collecting at the bottom. The recycling system includes a trough with a rotating vane that opens and closes the open top of the trough, where one end of the trough is cyclically closed by and end cap on the rotating vane. The rotating vane is rotated by an electric motor. Another electric motor operates continuously rotating fan that blows the artificial snow from the trough through a conduit to the top of the window-like structure where it collects on a tray which is tripped to release the artificial snow.

10 Claims, 4 Drawing Sheets

WINDOW-LIKE DISPLAY WITH SNOW EFFECT

BACKGROUND OF THE INVENTION

The present invention relates to a window-like display with a snow effect, and in particular a window-like snow display with a recycling system to provide the illusion of continuous snow fall.

Conventional window-like displays most often use a pair of spaced panes sealed on theft ends so the space between the panes can be filled with a fluid, such as water, Particles contained in the fluid float downward like a snowfall, and are recycled to the top of the display to give the effect of continuous snowfall. Some displays use a shaking system to recycle the particles, while others use a pumping system to create a recycling, and still others use air to force bubbles, particles and fluid to recycle.

Still another window-like display with simulated snowfall uses an air pump for recycling imitation snow from the bottom of the display to the top. The display has a front pane and a spaced back panel. There is a receptacle at the bottom of the display, which has an opening into the space between the front pane and the back panel. The receptacle is connected to an air blower that has a conduit to a funnel near the top of the display. The funnel is shaped to direct the circulating imitation snow into the top of the space between the front pane and the back panel. One problem with this type of display is there is no way to interrupt the airflow, therefore, the circulating imitation snow is forced downward instead of floating downward as with nature's snowfall.

SUMMARY OF THE INVENTION

The present invention provides a display that simulates snowfall, where a fan circulates the imitation snow and the flow is interrupted in three distinct ways so that the appearance of the falling snow is both heavy and light. The invention has one or more front panes, which are transparent, and a spaced rear pane that may be opaque or transparent. The front of the display looks like a window; in fact, the display is either hung on a wall to further the illusion of a window and snow falling or, hung in a window. The snow falls between the front pane or panes and the rear pane. When the snow reaches the bottom of the display, it fills a trough having a half round cross-section. A rotating vane of a size large enough to rotate within the trough and come close to the inside surface of the trough without actually touching it. The end of the vane in the trough has a shut-off cap, which can rotate into the trough to close one end. A circulating fan at the same end of the trough circulates snow in the trough through a conduit to the area at the top of the display. The circulating fan is constantly operating, therefore, to interrupt air circulation through the trough and allow snow to collect on the vane; the air shut off rotates into the front of the fin.

In the daytime, this very light realistic looking window hangs in your window. It is 4 feet tall by 3 feet wide and only 3 inches thick. There are 2 plexi glass windowpanes on the front and one large one on the back. At the flick of a switch we get the illusion of snow falling between the windowpanes. Because the artificial window is right up against your window, we see right through it into your yard where it appears to be snowing. Regardless of where you live, whether it's Christmas day or a hot day in June, you can have a snowy winter day or evening.

The same window for evening and night use has the back piece of plexi glass taken off and replaced with a translucent or black backdrop. It also comes with curtains and an attachable windowsill. It will hang on your wall perhaps in the place of a painting. It looks like a real window but when turned on gives the illusion of a cold snowy evening. To make the window seem even more realistic, you might want to make your own curtains for the window matching the others in your living room or room of your choice. Next to the Christmas free, the artificial snow window is the ultimate Christmas decoration.

The process by which the artificial snow recycles works as follows: At the bottom of the window between the two plexiglass panes is a trough or half cylinder. At one end of the trough there is an attached fan. At the other end there is attached tubing going up the left side of the window to the top. The trough has a lid or vane, which extends the entire length of the trough. When the artificial snow is poured into a hatch at the top left corner of the window, most of it will fall to the bottom and land on the trough lid. The trough lid is driven by a motor, which is on a timer. The motor will turn the trough lid or vane one complete revolution every 4 seconds. This allows the artificial snow to fall through into the trough. The fan at one end of the trough blows air through the trough constantly. This constant air force carries the artificial snow up the tubing to the top where it dispenses then recycles. As the trough or vane lid is turning to allow more snow to enter the trough, an air block fin also is moving from being on top of the trough to inside the trough where it blocks the air flow so that no artificial snow can blow upward and out of the trough. When the trough lid turns back to close off the trough, the air block fin is now back on top of the trough, which will allow the air flow to continue to blow through the trough and carry the artificial snow up the tubing to be dispensed. About one third of the artificial snow that dispenses from the tubing will land on the three-quarter inch storage vane which extends between two side guide walls. These guide walls confine the snow area bounded by the front and rear panes and the side walls. The storage vane lies about six inches below where the artificial snow dispenses. This artificial snow accumulates on the vane for brief seconds when the trough lid or vane (below) has the air block fin in a position (on top) where the air can blow through the trough and carry the artificial snow to the top. At that moment the cylinder vane revolves and raises to its highest point during which time, the storage release bar trips the storage tray to release the artificial snow. After it empties, the vane automatically falls back to the load position Just above the halfway point and built into the Styrofoam wall is the storm fan. Not only will the fan give the effect of a snowstorm, but also it will assist in directing the artificial snow downward into the trough to be recycled.

In nature, precipitation never falls in a uniform pattern. The artificial snow window produces the same natural effect for the following reasons:

1. The blow down fan (or storm fan) blows the artificial snow around.
2. The trough lid revolves every four seconds each time shutting off the snow supply for brief seconds.
3. The storage tray releases artificial snow each time the trough lid revolves. Hence, the effect is quite realistic.

It is the object of this invention to provide a window like display with an air and imitation snow circulation system providing a viewer with the feeling of snowfall at any time of day or night or any season.

DESCRIPTION OF THE PREFERRED EMBODIMENT(S)

Figure 1:
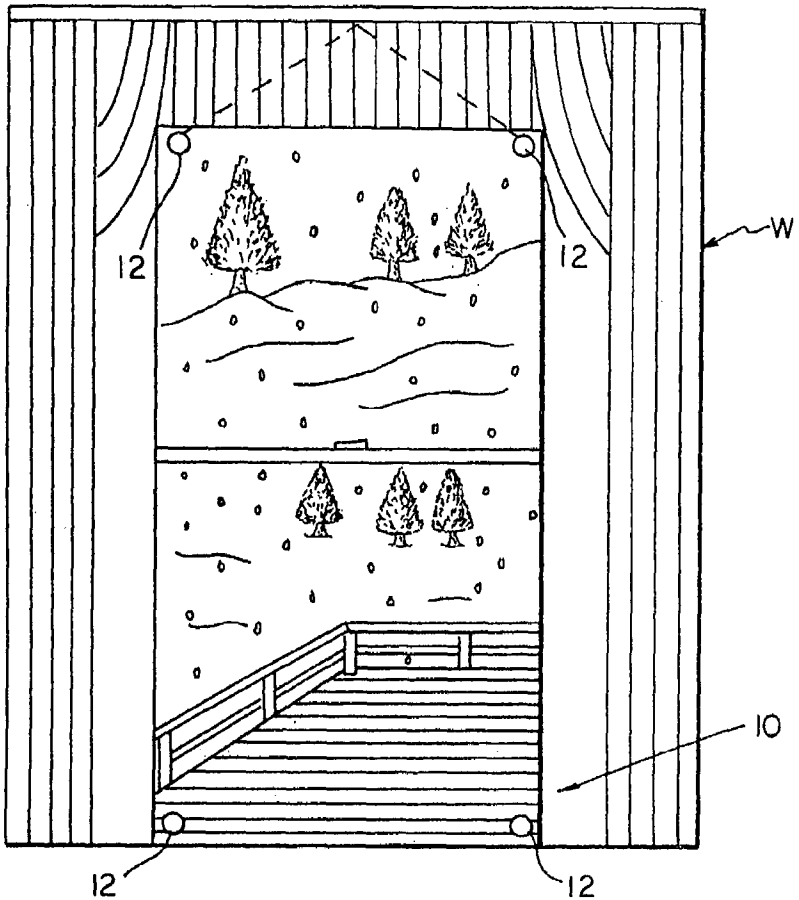
FIG. 1 shows a window like display hanging in a real window or with adjustments on a wall.

Referring to the drawings, FIGS. 1 to 10, there is shown in FIG. 1 a display 10 mounted on a window "W" by suction cups 12. The display 10 is transparent to show the outside with the effect of snowfall.

Figure 2:
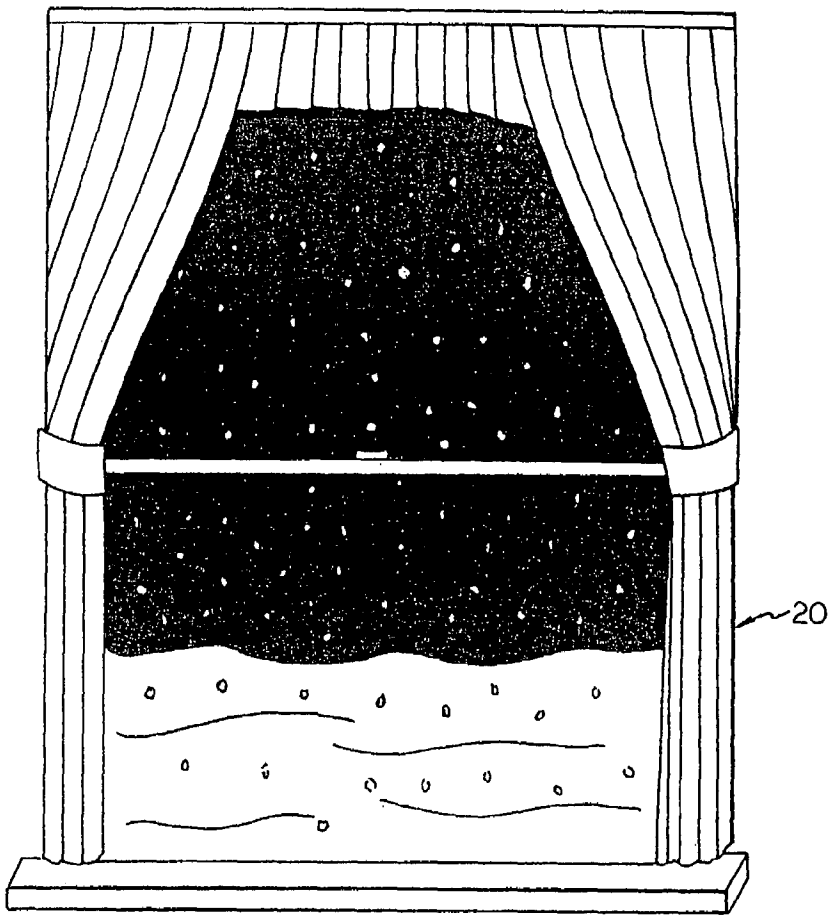
FIG. 2 shows another embodiment of the invention.

A second embodiment is shown is FIG. 2 where a display 20 is shown hanging on a wall by conventional brackets, not shown. Display 20 is designed to look like a window but hangs on the wall and has an opaque background and the appearance of snow falling.

Figure 3:
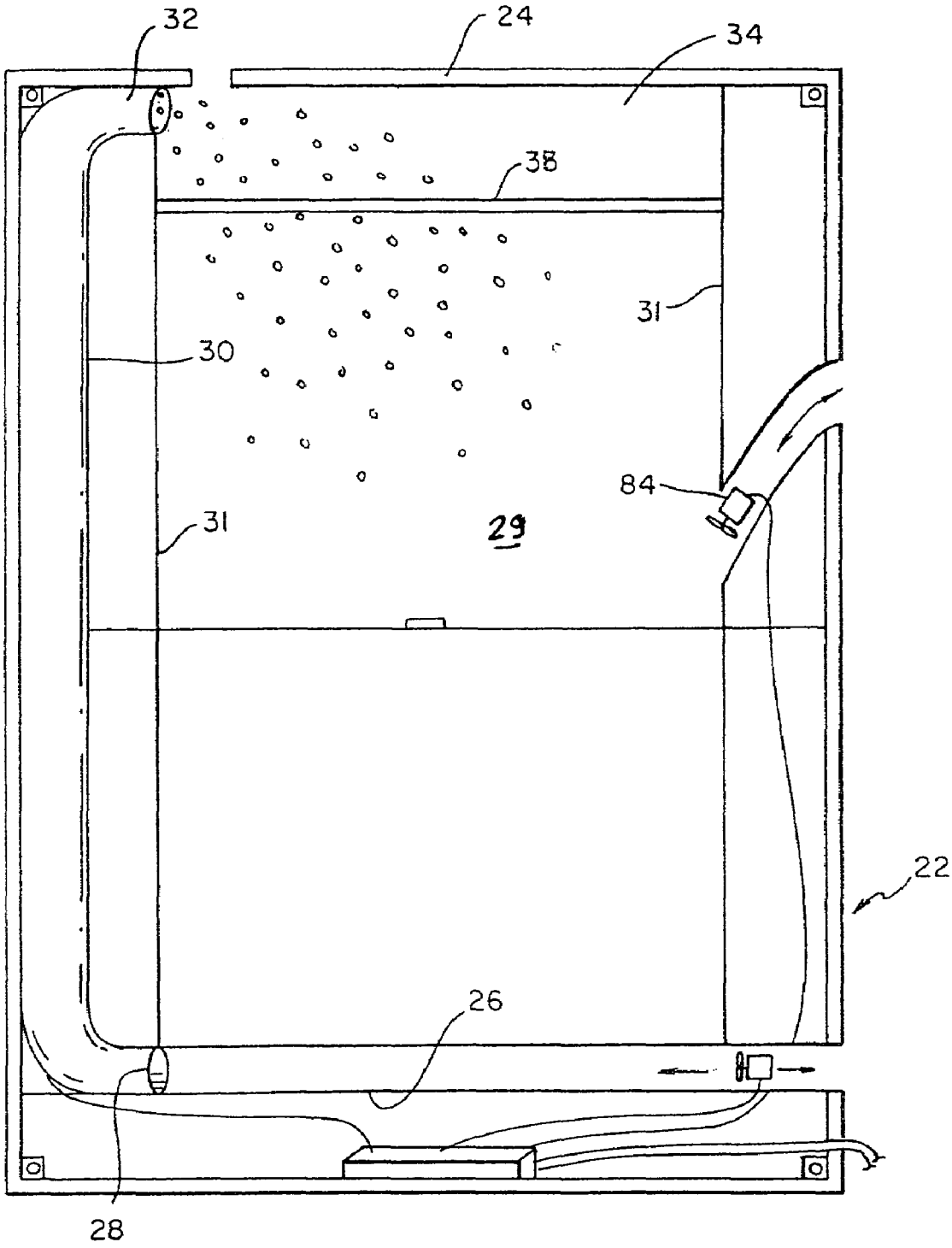
FIG. 3 shows an air circulation system of the invention.

The system, which stimulates snowfall, works with either the embodiment of FIG. 1 or the embodiment of FIG. 2. In FIG. 3 a cut-away view shows a circulating system 22 for taking collected snow at the bottom of the display 22 (using the display of FIG. 2 to represent both embodiments). The display has a frame 24 and front transparent panes 25 (FIG. 8*a*), and a rear panel 27 (FIG. 8*a*) which is either transparent or opaque. Frame 24 supports the front panes and the rear panel providing a display space 29 between the side walls 31, the front panes 25 and the rear panel 27, through which the snow falls. The circulation system 22 of FIG. 3 includes a trough 26, which is open on both ends. One end 28 is connected to a conduit 30, which extends vertically inside frame 24 and has a nozzle 32 at its upper end. A portion of the snow collects at the top of the display in an upper space 34 with an open bottom. The upper space 34 has a vane 38, which opens at timed intervals to dump snow into the space between the front panes 25 and the panel 27.

Figure 4:
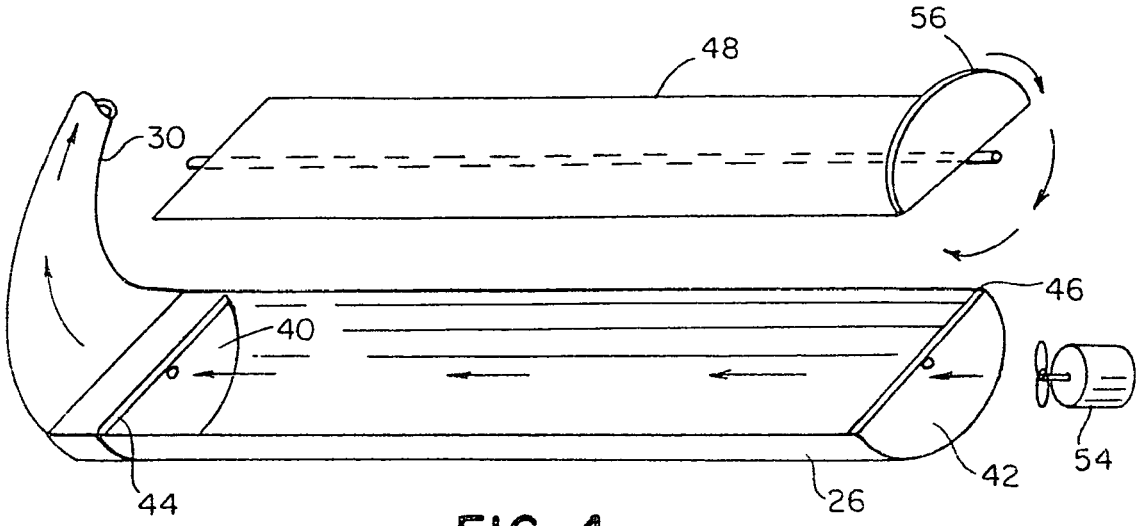
FIG. 4 is a perspective view of a trough and air circulation system of the invention.
Figure 5:
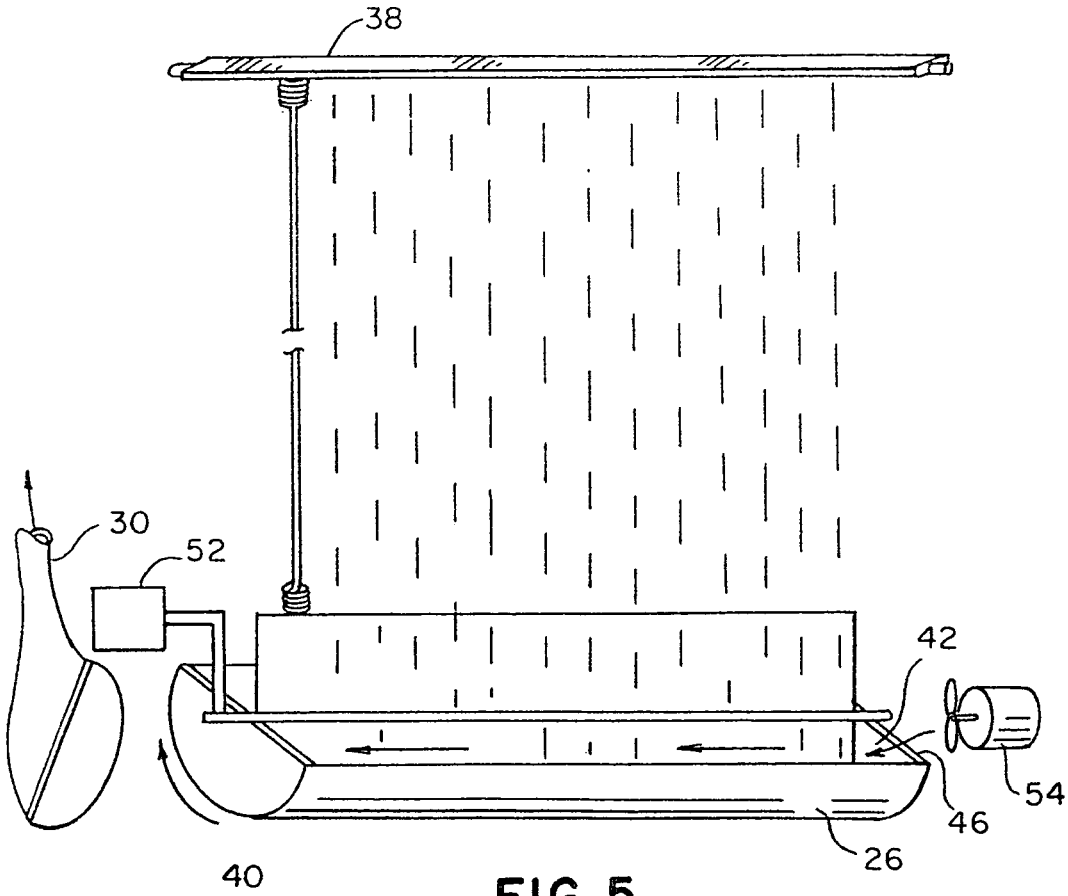
FIG. 5 is another perspective view of a trough and air circulation system of the invention.

FIG. 4 shows trough 26 with a half round shape. The trough 26 has open ends 40 and 42 with support bars 44 and 46. End 40 connects to the conduit 30. A vane 48 has a rotating rod 50, best shown in FIG. 6, which rotates in support bars 44 and 46. An electric motor 52 rotates vane 48 so that it sweeps inside the trough 26 without contacting it. A second electric motor 54, represented by a fan blade, is mounted near the other end 42 of the trough to force air through the trough 26 and conduit 30. In order to collect larger quantities of snow for circulation, a shut off cap 56 is internally formed on vane 48. The shut off cap 56 rotates as part of vane 48, and passes through the trough 26 shutting off airflow.

Figure 9A:
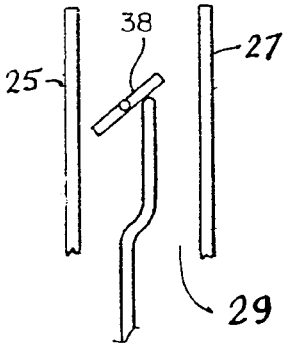
FIGS. 9*a*–9*d* show the cycling of the dispensing vane.
Figure 9A:
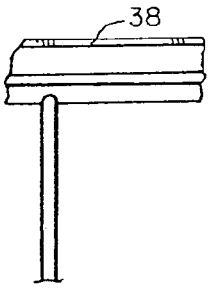
Figure 9A:
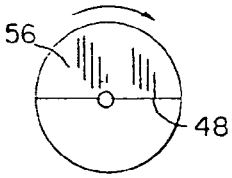
Figure 9B:
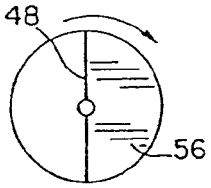

The vane 48 rotates one complete revolution every four seconds. FIGS. 9*a* to 9*d* show one revolution of vane 48. In FIG. 9*a*. the vane 48 is horizontal with the shut off cap 56 extending upward. FIG. 9*b* shows the vane 48 in a vertical position with the shut off cap 56 extending to the right in front of electric motor 52 and its fan blades shutting off air flow through the trough 26. The vane 48 is again horizontal in FIG. 9*c* with the shut off cap 56 completely shutting off the trough 26 and continuing to shut off airflow, In FIG. 9*d* the vane 48 is vertical with the shut off cap 56 to the left, opening the right side of the trough 26.

Figure 9C:
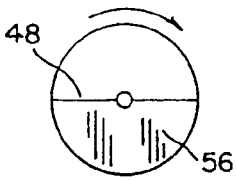

While the vane 48 is cycling through its different positions, the snow flows through the display and through the trough 26. In FIG. 9*a* snow collects on the vane 48 while snow is blown through the trough 26 and through the conduit 30 and about one third of it collects on the upper vane 38. In FIG. 9*b*, snow collected on the vane 48 is dumped into the right side of trough 48, while air continues to blow snow through the left side of the tough 26, conduit 30 and through upper space 34. FIG. 9*c* shows the vane 48 horizontal to collect snow while the snow flows through the trough 26 and the conduit 30 and the fall is completely stopped. Snow that has collected on the vane 48 is dumped into the trough 26 where it is blown through conduit 30.

Figure 9D:
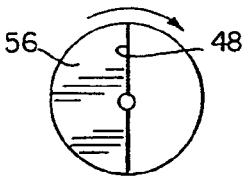

As the vane 48 rotates, the accumulated snow on it dumps when the cylinder vane turns to its highest point, which corresponds to FIG. 9*d* when the van 48 is vertical and the shut off cap 56 is to the left.

Figure 8A:
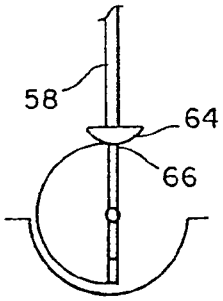
FIG. 8*a* is a cross section view of a rotating vane operating a dispensing vane.

FIG. 8*a* shows an operating rod 58.

Figure 8B:
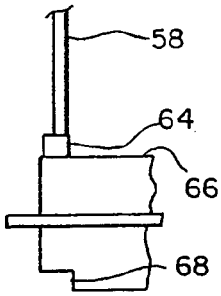
FIG. 8*b* is a side view of the dispensing vane.

The lower end of rod 58 has an arcuate shaped follower 64 which rides on the vane edge 66 so that each time the vane 48 is in the position of FIG. 9*d*, the vane 38 is opened. When the vane 48 is in the position of FIG. 9*b*, the vane 38 is not opened, since as shown in FIG. 8*b* there is a cutout notch 68 to prevent the follower 64 from contacting vane 48.

Figure 7:
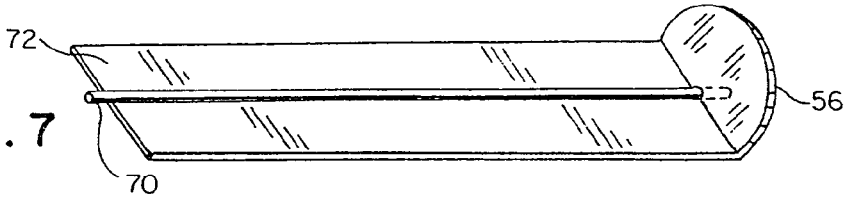
FIG. 7 is a perspective view of a vane of the invention.
Figure 10:
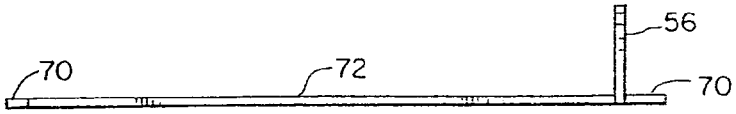
FIG. 10 is a side view of the vane of FIG. 7.

FIGS. 7 and 10 show vane 48 having a rectangular shape with a rotating rod 70 affixed to the rectangular surface 72, extending down the center of the vane and protruding beyond each end, The rotating rod 70 rides in apertures, not shown, in supporting bars 44 and 46. Shut off cap 56 is integrally formed with vane 48 by bending one end of the vane at a right angle to rectangular surface 70, as shown in FIG. 10.

Figure 6:
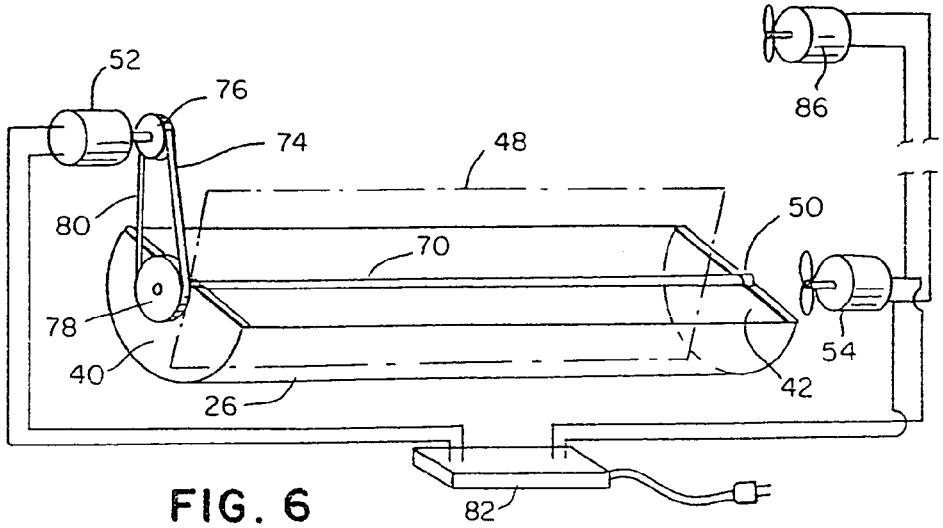
FIG. 6 is another view of the trough and air circulation system of the invention.

FIG. 6 shows the electrical system for operating the snow flow through the display 20. Trough 26 and vane 48 are shown with a pulley system 74 for rotating vane 48. There is a drive pulley 76 turned by electric motor 52 and a driven pulley 78 mounted on rotating rod 70. A pulley belt 80 connects the pulleys together so that pulley 76 turns pulley 78. The size relationship between the pulleys and the R.P.M. of the electric motor 52 is such that the vane makes one revolution every four seconds. Electric motor 52 is wired into electrical box 82, which plugs into a wall outlet, not shown. Electric motor 54 with its fan continuously operates as explained. There is also a third electric motor 86, which is wired along with electric motor 54 to electrical box 82. Electric motor 86 has a fan for creating a swirling effect on the snow as it flows downward through the display 20.

In operation, the display 20 is hung on a wall to simulate a window. The electrical unit is plugged into a wall outlet, turning on the circulating system. Snow is dispensed from the top left corner of conduit onto storage vane. The snow that falls past the storage vane (as it is only ¾ inch wide) is directed downward via fan motor 84 giving it a realistic appearance. When the snow reaches the bottom of the display 20, it either collects on the vane 48 or falls into trough 26. Snow which collects on the vane 48 is dumped into the trough 26 as the vane rotates into the trough. The electric motor 54 is connected to a fan, which blows snow from the trough through a conduit 30 back to space 34. The shut off cap 56 on vane 48 rotates into trough 26 shutting off airflow while snow collects on the vane. When the vane 48 dumps the snow, shut off cap 56 opens the trough 26 to permit snow flow. At the same time the edge 66 of the vane 48 contacts the rod which trips open vane 38. The vane 38 repeats its cycle every four seconds, creating the appearance of snow.

While only some embodiments of the invention have been explained, other embodiments may be realized. For example, gears or a direct drive could replace the pulleys and pulley belt. Other mean could replace the vane operating rod without departing from the invention. For a complete understanding of the invention one should look to the drawings, description and claims.

The invention claimed is:

1. A display device for simulating a window and snow fall, said device comprising:

at least two front panes;

a rear panel;

a display opening between said front panes;

an upper space between said front panes, above said display opening;

a conduit extending in said frame on one side of said display opening;

a trough in said frame below said display opening where said conduit connects to a first end of said trough and said conduit has a nozzle to dispense imitation snow into said upper space;

means to cyclically open and close said upper space to empty snow into said display space; and an operating means for alternately allowing the snow to enter said trough and said conduit for recycling and blocking the snow from entering said trough.

2. A display device as in claim 1 wherein said operating means comprises a first vane covering said trough and means for rotating said first vane into said trough whereby when said first vane covers said trough snow collects on it and the snow is emptied into said trough as said first vane rotates.

3. A display device as in claim 2 wherein said operating means includes an air fan to recycle said snow.

4. A display device as in claim 3 wherein said first vane has a shut off cap at right angles to said first vane and on one end thereof to periodically open and close said trough to said air fan.

5. A display device as in claim 4 wherein said operating means controls the means to cyclically open and close said upper space.

6. A display device as in claim 5 wherein said means to cyclically open and close said upper space comprises a second vane, and wherein said operating means opens and closes said second vane once every revolution of said first vane.

7. A display device as in claim 6 wherein said first vane pushes a connecting rod attached to said second vane in said upper space to open said upper space when a first edge of said first vane contacts said connecting rod, wherein a second edge of said first vane is notched to avoid contacting said connecting rod.

8. A display device as in claim 7 wherein said first vane makes one complete revolution every four seconds.

9. A display device as in claim 8 wherein said shut off cap on said first vane blocks said air fan 3 out of every 4 seconds at least in part during the revolution of said first vane.

10. A display device as in claim 9 further comprising a means to create an illusion of the snow swirling as it falls through the display.

* * * * *